US007972126B2

(12) United States Patent
Jordan

(10) Patent No.: US 7,972,126 B2
(45) Date of Patent: Jul. 5, 2011

(54) POWER STEERING SYSTEM HYDRAULIC PUMP

(75) Inventor: Martin Jordan, Düsseldorf (DE)

(73) Assignee: TRW Automotive GmbH (DE)

( * ) Notice: Subject to any disclaimer, the term of this patent is extended or adjusted under 35 U.S.C. 154(b) by 704 days.

(21) Appl. No.: 11/795,676

(22) PCT Filed: Jan. 19, 2006

(86) PCT No.: PCT/EP2006/000461

§ 371 (c)(1),
(2), (4) Date: Apr. 10, 2008

(87) PCT Pub. No.: WO2006/077121

PCT Pub. Date: Jul. 27, 2006

(65) Prior Publication Data

US 2009/0123320 A1 May 14, 2009

(30) Foreign Application Priority Data

Jan. 20, 2005 (DE) ..... 10 2005 002 757

(51) Int. Cl.

| | |
|---|---|
| ***F04C 27/00*** | (2006.01) |
| ***F01C 1/18*** | (2006.01) |
| ***F04C 2/18*** | (2006.01) |
| ***F04C 18/18*** | (2006.01) |

(52) U.S. Cl. ..... 418/206.6; 418/206.1; 418/149

(58) Field of Classification Search ..... 418/206.1, 418/206.6, 149

See application file for complete search history.

(56) References Cited

U.S. PATENT DOCUMENTS

| | | | | |
|---|---|---|---|---|
| 2,871,794 | A | 2/1959 | Mosbacher | |
| 3,096,719 | A | 7/1963 | McAlvay | |
| 3,101,673 | A | 8/1963 | Clark et al. | |
| 3,416,459 | A | 12/1968 | Reimer et al. | |
| 4,770,612 | A | 9/1988 | Teubler | |
| 6,390,793 | B1 | 5/2002 | Sweet et al. | |
| 6,902,382 | B2 * | 6/2005 | Christensen et al. | 418/206.1 |
| 7,488,162 | B2 * | 2/2009 | Jordan | 418/206.1 |
| 2005/0238505 | A1 * | 10/2005 | Iwasaki | 417/410.4 |
| 2006/0051230 | A1 | 3/2006 | Jordan | |

FOREIGN PATENT DOCUMENTS

| | | | |
|---|---|---|---|
| DE | 1 553 216 | | 9/1969 |
| DE | 1 553 262 | | 7/1970 |
| DE | 1 653 880 | | 9/1971 |
| DE | 36 23 421 | A1 | 1/1988 |
| DE | 203 02 535 | U1 | 6/2003 |
| EP | 0 012 328 | A1 | 6/1980 |
| EP | 0012328 | A1 * | 6/1980 |

* cited by examiner

*Primary Examiner* — Thomas E Denion
*Assistant Examiner* — Mary A Davis
(74) *Attorney, Agent, or Firm* — MacMillan, Sobanski & Todd, LLC

(57) ABSTRACT

A power steering system hydraulic pump has a pump component which is to be sealed and a first pump cover. A flat sealing element is provided between the pump component which is to be sealed and the first pump cover.

9 Claims, 3 Drawing Sheets

POWER STEERING SYSTEM HYDRAULIC PUMP

CROSS-REFERENCE TO RELATED APPLICATIONS

This application is a National Stage of International Application No. PCT/EP2006/000461 filed Jan. 19, 2006, the disclosures of which are incorporated herein by reference, and which claimed priority to German Patent Application No. 10 2005 002 757.1 filed Jan. 20, 2005, the disclosures of which are incorporated herein by reference.

BACKGROUND

Various embodiments of a power steering system hydraulic pump are disclosed herein. In particular, the embodiments described herein relate to an improved power steering system hydraulic pump having a pump component, which is to be sealed, and a first pump cover.

Such pumps are generally part of a motor/pump unit for power steering systems of motor vehicles. DE 203 02 535 U, and corresponding U.S. Patent Application Publication No. 2006/0051230 A1, both of which are incorporated by reference herein, shows a generic hydraulic pump for a power steering system which can be inserted as a prefabricated unit into a motor/pump unit. The pump here comprises a housing which is closed at its end faces by a respective pump cover. The two covers are braced against each other by at least one holding piece, whereby it is possible to assemble the pump at a favorable cost and without effort.

The sealing between the pump covers and the housing on the one hand and between the pump covers and the installation pieces of the housing (e.g. the bearing rests) on the other hand takes place in DE 203 02 535 U by sealing rings, as usual. The sealing rings may be circular, oval or heart-shaped here, and may have a round or rectangular cross-section. Irrespective of their shape or their cross-section, all the mentioned sealing rings abut substantially linearly at the components which are to be sealed. As these are generally elastomer seals, a precisely worked groove must be present in one of the components abutting at the seal. In addition, there is effort involved in processing the surface of the groove in order to ensure the desired sealing effect.

BRIEF SUMMARY

The present application describes various embodiments of a power steering system hydraulic pump which provides a seal between two components of a power steering system hydraulic pump that is simple and as favorably priced as possible.

In a power steering system hydraulic pump having a pump component which is to be sealed and a first pump cover, a flat sealing element is provided for this purpose between the pump component which is to be sealed and the first pump cover. The costly working of the pump cover by the precise milling and finishing processing of a groove for the ring seal, which seals substantially in a linear shape, is eliminated. The pump cover, which hitherto was usually an aluminum die cast metal part, may be replaced, for example, by a favorably priced stamped part made of steel.

The pump component which is to be sealed may be a bearing rest. Bearing rests adjoin the pump cover in particular in external geared pumps and lie against the pump cover so as to be damped with regard to noise and sealed by means of the flat sealing element.

In addition, it is possible for the pump component which is to be sealed to be a housing. A tight connection is generally also necessary between this housing of the pump and the pump cover. This is particularly readily possible through the flat sealing element which is present.

In one embodiment, the flat sealing element is a flat seal. This can be adapted to shape of the pump cover in a simple manner such that all the adjoining pump components are tightly connected with the pump cover through this one flat seal.

In another embodiment, the flat sealing element is at least partially made of metal. Metallic seals can receive a high transverse pressure and achieve a reliable sealing effect despite high stresses.

Moreover, in the embodiments of the power steering system hydraulic pump described herein, a second pump cover having a ring seal is present, the ring seal being arranged between the second pump cover and a pump component which is to be sealed. In such a case, the advantages of both types of seal can be utilized in a hydraulic pump. As described herein, ring seals are defined such that they surround an area and seal it substantially linearly. The surrounded area does not have to be circular, but rather may have any desired geometric shape. The ring seals are usually produced from an elastomer.

In this embodiment, it is sensible that the ring seal of the second pump cover completely undertakes the compensation of size tolerances of the pump components. Owing to the conventional manufacturing materials and the lower pressure of the ring seal as a result of guidance in the cover groove, this is better suited for the compensation of the axial play than the flat sealing element. A further advantage is that the bearing rests can likewise be constructed so as to be flat, therefore can manage without a sealing groove.

Further, the power steering system hydraulic pump may likewise comprise a housing, in which, under operating pressure, the surface of the pump components, in particular of the bearing rest, acted upon by pressure, in the housing is smaller on the side facing the flat sealing element than on the side facing the ring seal. Through this measure, a resulting force of the pump components is produced in the housing onto the flat sealing element. It is thereby ensured that the pump components which are to be sealed always lie against the flat sealing element.

Other advantages of the power steering system hydraulic pump will become apparent to those skilled in the art from the following detailed description, when read in light of the accompanying drawings.

DETAILED DESCRIPTION

Figure 1:
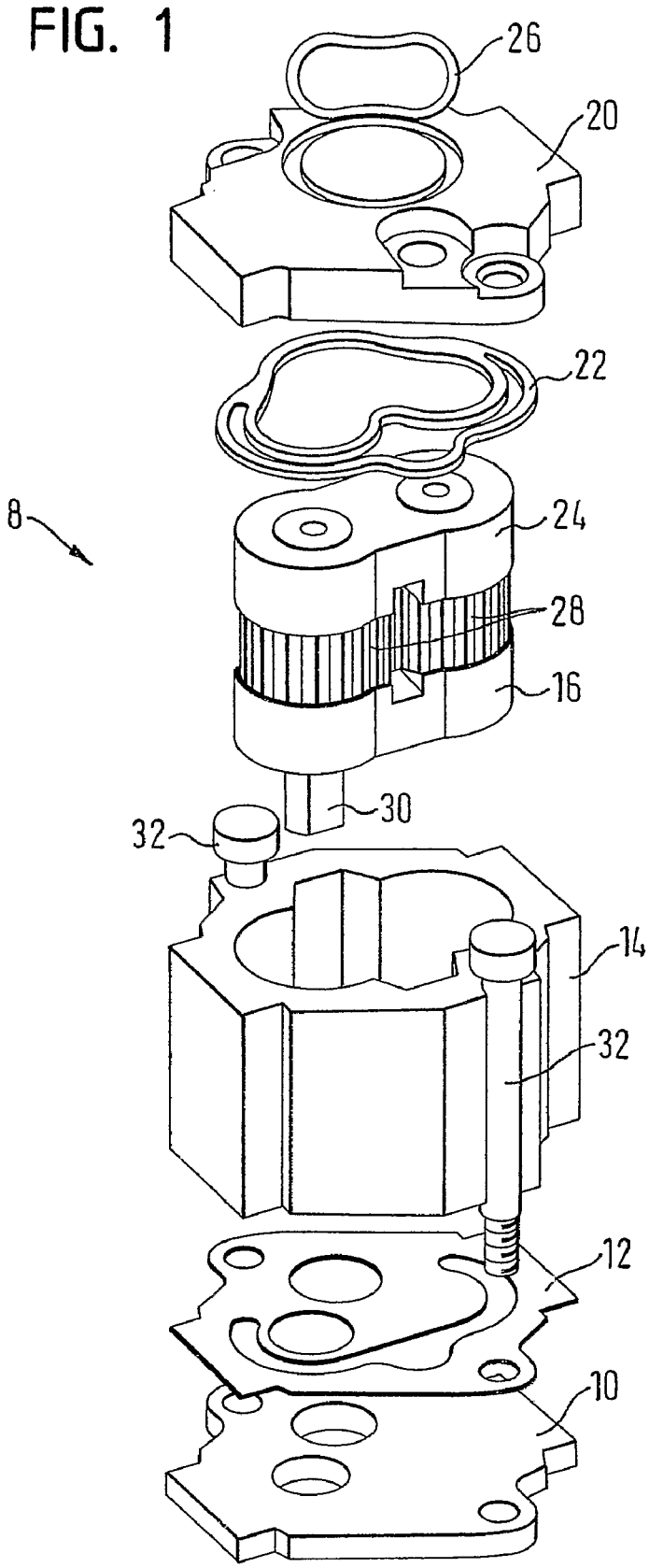
FIG. 1 shows an exploded view of a power steering system hydraulic pump.

FIG. 1 illustrates a power steering system hydraulic pump 8 having two pump components which are to be sealed and a first pump cover 10, a flat sealing element being provided between the pump components which are to be sealed and the first pump cover 10. In this example, the pump components which are to be sealed are a housing 14 and a first bearing rest 16. The hydraulic pump 8 additionally comprises a second pump cover 20 having a ring seal 22, the ring seal 22 being arranged between the second pump cover 20 and a pump component which is to be sealed. The components which are to be sealed here are a second bearing rest 24 and again the housing 14. A spring ring 26 which compensates for the axial play of the hydraulic pump 8 on installation into a motor/pump unit (not shown) is additionally illustrated on the upper side of the second pump cover 20. As in FIG. 1 an external-gear pump is shown, the pump gear, consisting of two meshing gear wheels 28, is situated between the bearing rests 16, 24. Each of the two gear wheels 28 is connected with a shaft, its shaft journals being held in the bearing rests 16, 24. A drive shaft 30 extends through the first bearing rest 16, the flat seal 12 and the first pump cover 10. The drive shaft 30 therefore projects out from the interior of the pump and can be driven by a motor (not shown).

On its outside, the housing 14 has axial guides for two holding elements 32. The holding elements 32 are guided through openings in the first and second pump covers 10, 20 and hold the hydraulic pump 8 together.

In the assembled state, the bearing rests and the pump gear are introduced into an axial opening of the housing 14. The axial opening of the housing 14 is closed on the upper- and underside by the pump covers 10, 20.

The flat seal 12 is provided between the first pump cover 10 and the housing 14 and between the first pump cover 10 and the first bearing rest 16, respectively. The flat seal 12 may be a plate made of steel which is coated on both sides with an elastomer, but it may also be produced from a soft metal. The flat seal 12 extends over almost the entire surface of the first pump cover 10 and therefore seals between the first pump cover 10 and the housing 14 and the first bearing rest 16, respectively.

The pump drive, the bearing rests 16, 24 and the housing 14 have an axial play owing to tolerances in size. This axial play must be compensated by the present seals of the hydraulic pump 8 in order to ensure a secure seat for the pump components and also a problem-free functioning of the hydraulic pump 8. The flat seal 12 is not suitable to receive this axial play, because the metallic layer is too hard and the elastic layer which may be present is very thin.

For this reason, in the present example of FIG. 1 the second pump cover is provided in a known manner with a groove to receive the ring seal 22. This ring seal 22 usually consists of an elastomer and can fully receive the axial play.

For the instance where the manufacturing technology reaches a higher accuracy of measurement for the pump components and the axial play is substantially eliminated, it is of course possible and advantageous to also construct the second pump cover 20 as a simple stamped part and to replace the ring seal 22 by a flat seal 12.

Figure 2:
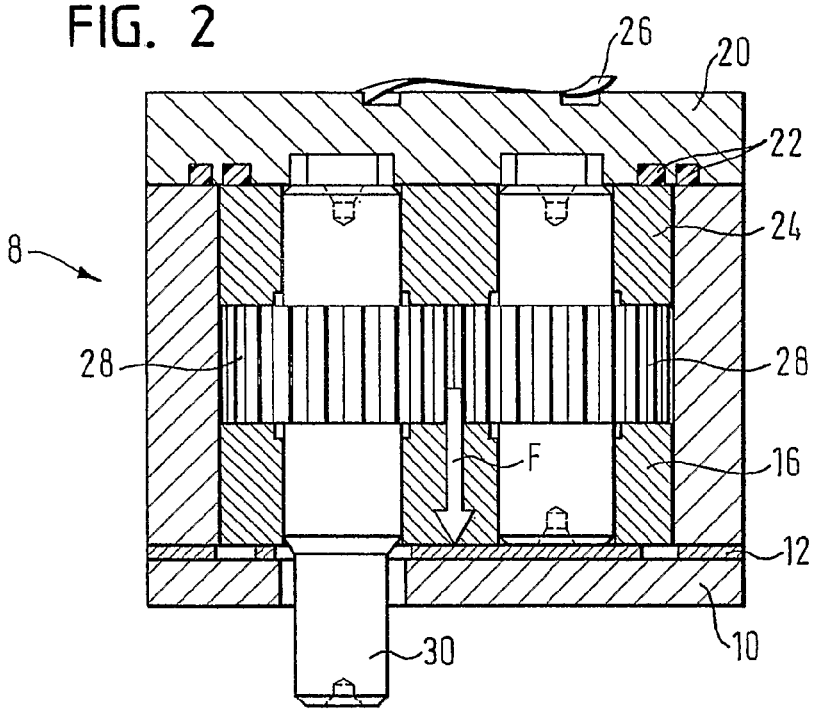
FIG. 2 shows a section through the power steering system hydraulic pump illustrated in FIG. 1.

FIG. 2 shows an axial section through the two shaft axes of the assembled hydraulic pump of FIG. 1. As the axial play of the pump components can not be equalized by the flat seal 12, the bearing rests 16, 24 together with the pump drive must be pressed by a force F onto the flat seal, in order to prevent a "lifting" of the first bearing rest 16 from the flat seal 12. This necessary force F is illustrated by an arrow in FIG. 2.

Figure 3:
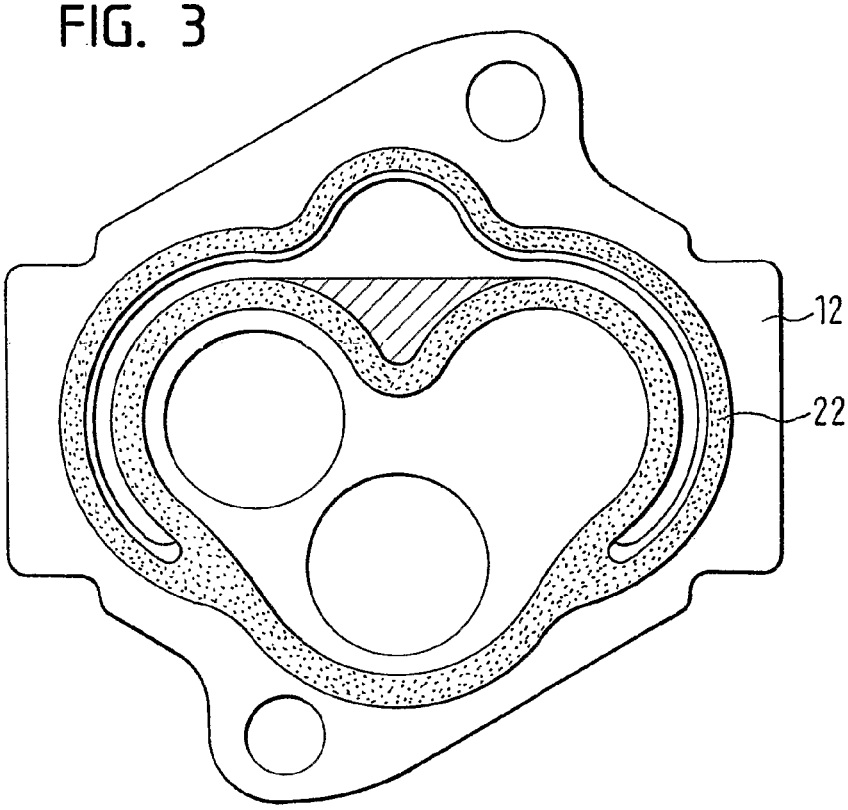
FIG. 3 shows a top view onto the flat seal of FIG. 1.

The force F occurs as the resulting force from a difference of the surfaces of the pump components, in particular of the bearing rest, in the housing 14 which are acted upon with pressure on the end face. This area difference is shown in FIG. 3. The flat seal 12 can be seen there in top view and the position of the ring seal is emphasized in black. The second bearing rest 24 is acted upon by the operating pressure of the pump in the region of the ring seal 22 on the hatched surface, whereas the first bearing rest 16 is not acted upon by pressure in this region, but rather is sealed by the flat seal 12. Therefore, under operating pressure, the surface of the pump components in the housing 14, acted upon by pressure, is smaller on the side facing the flat sealing element than on the side facing the ring seal 22. The vertical force F onto the flat seal 12 results from this difference in area acted upon by pressure.

Figure 4:
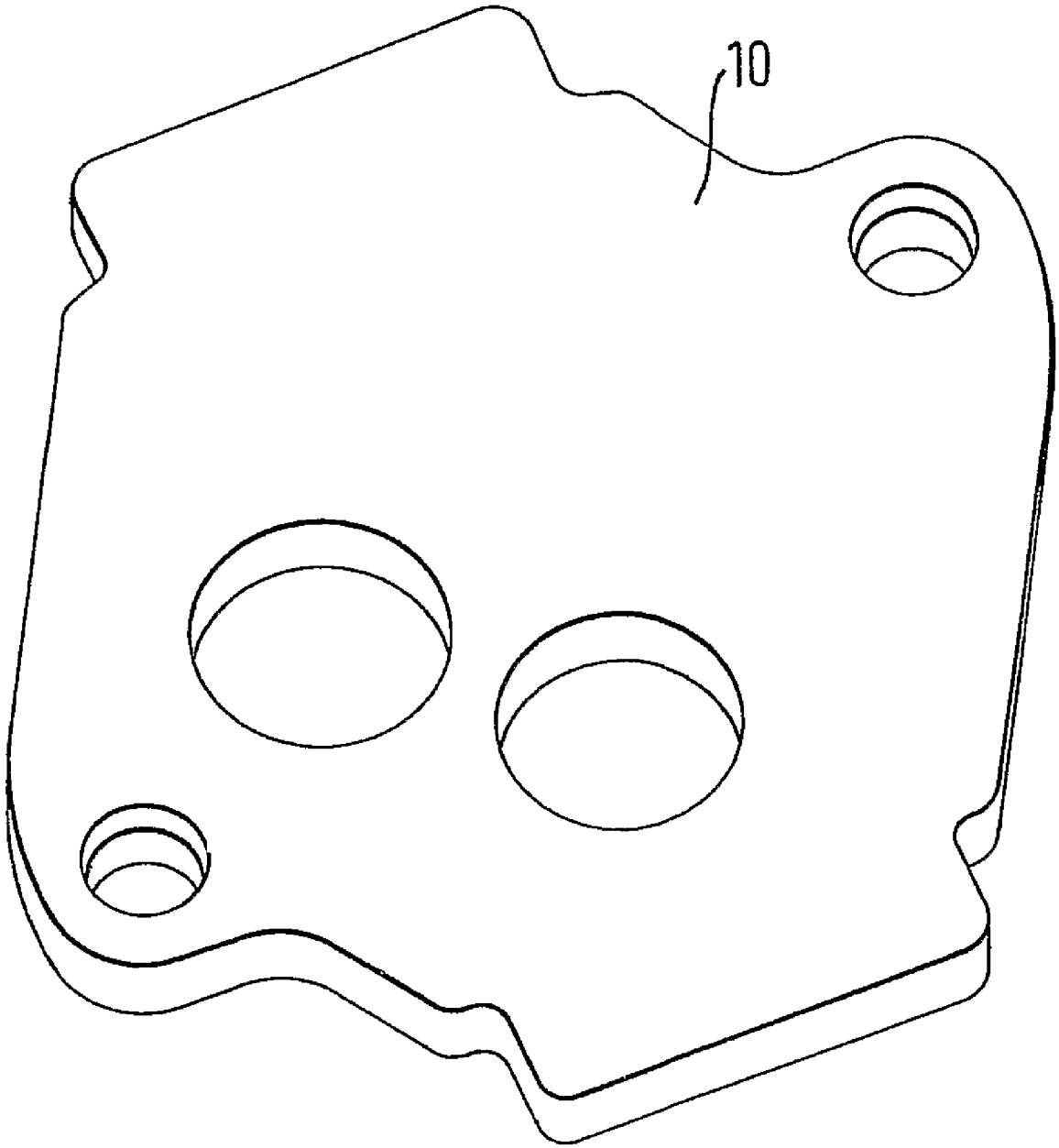
FIG. 4 shows a perspective view of the first pump cover of FIG. 1.

FIG. 4 shows the first pump cover 10 in detail. This first pump cover is generally made of steel and can be produced as a simple stamped part. This results in a considerable cost advantage compared with the conventional pump covers, e.g. of aluminum die cast metal having a groove and a costly subsequent processing of the groove.

In accordance with the provisions of the patent statutes, the principle and mode of operation of the power steering system hydraulic pump have been explained and illustrated in its various embodiments. However, it must be understood that the power steering system hydraulic pump described herein may be practiced otherwise than as specifically explained and illustrated without departing from its spirit or scope.

The invention claimed is:

1. A power steering system hydraulic pump having a set of gear wheels, a first bearing rest and a second bearing rest arranged within a housing, the first and second bearing rests being arranged on opposite sides of the gear wheels, a flat seal being arranged between said first bearing rest and a first pump cover, a ring seal being arranged between said second bearing rest and a second pump cover as well as between said second pump cover and said housing, thereby equalizing size tolerances present between said housing, said bearing rests and said gear wheels.

2. The power steering system hydraulic pump according to claim 1, wherein the flat seal is made at least partially of metal.

3. The power steering system hydraulic pump according to claim 1, having pump components comprising of the set of gear wheels, the first bearing rest, and the second bearing rest; wherein under operating pressure a surface of the pump components acted upon by pressure in the housing is smaller on a side facing the flat sealing element than on a side facing the ring seal.

4. The power steering system hydraulic pump according to claim 1, wherein the first pump cover is constructed as a flat stamped part.

5. A power steering system hydraulic pump having pump components comprising of a set of gear wheels, a first bearing rest, and a second bearing rest; wherein the first and second bearing rests are arranged within a housing, the first and second bearing rests being arranged on opposite sides of the gear wheels, a flat seal being arranged between said first bearing rest and a first pump cover, and a ring seal being arranged between said second bearing rest and a second pump cover, the surface of the pump components acted upon by operating pressure in the housing being smaller on the side facing the flat sealing element than on the side facing the ring seal.

6. The power steering system hydraulic pump according to claim 5, wherein size tolerances present between the pump components are equalized by the ring seal of the second pump cover.

7. The power steering system hydraulic pump according to claim 5, wherein the flat seal is made at least partially of metal.

8. The power steering system hydraulic pump according to claim 5, wherein the first pump cover is constructed as a flat stamped part.

9. A power steering system hydraulic pump having pump components comprising of a set of gear wheels, a first bearing rest, and a second bearing rest; wherein the first and second bearing rests are arranged within a housing, the first and second bearing rests being arranged on opposite sides of the gear wheels, a flat seal being arranged between said first bearing rest and a first pump cover, and a ring seal being arranged between said second bearing rest and a second pump cover, said ring seal equalizing size tolerances present between said housing, said bearing rests and said gear wheels, the surface of the pump components acted upon by operating pressure in the housing being smaller on the side facing the flat sealing element than on the side facing the ring seal.

* * * * *